US008973166B1

(12) United States Patent
Engle

(10) Patent No.: US 8,973,166 B1
(45) Date of Patent: Mar. 10, 2015

(54) EDGING FOR BRIM OF CAP OR VISOR

(76) Inventor: Kyle Engle, Portsmouth, NH (US)

( * ) Notice: Subject to any disclaimer, the term of this patent is extended or adjusted under 35 U.S.C. 154(b) by 637 days.

(21) Appl. No.: 13/293,900

(22) Filed: Nov. 10, 2011

(51) Int. Cl.
*A42B 1/00* (2006.01)

(52) U.S. Cl.
USPC ..... 2/175.2; 2/175.1; 2/175.5; 2/195.1; 2/209.13; 2/209.12; 24/457; 24/462

(58) Field of Classification Search
USPC ..... 2/209.13, 10, 425, 422, 181, 209.12, 2/195.5, 195.6, 195.7, 195.1, 244, 175.1, 2/175.2, 175.5; 40/329, 666
See application file for complete search history.

(56) References Cited

U.S. PATENT DOCUMENTS 6,173,447 B1 * 1/2001 Arnold ..... 2/10
6,694,526 B1 * 2/2004 Tate ..... 2/209.12
7,178,173 B2 * 2/2007 Kronenberger ..... 2/209.13
7,461,764 B2 * 12/2008 Thompson ..... 223/14
8,381,359 B1 * 2/2013 McArdle ..... 24/3.12
2002/0042941 A1 * 4/2002 Grundy ..... 2/195.1
2005/0172380 A1 * 8/2005 Turkington ..... 2/175.4
2009/0013439 A1 * 1/2009 Thoman ..... 2/10

* cited by examiner

*Primary Examiner* — Danny Worrell
*Assistant Examiner* — Khaled Annis
(74) *Attorney, Agent, or Firm* — Joseph E. Funk

(57) ABSTRACT

An attachment for the edge of an extending brim of a baseball type cap or visor is disclosed which is mounted on the edge of the extending brim to protect or repair the edge. The attachment easily mounts on the brim of a cap or visor and remains securely thereon. The brim is inserted into a slot through the side and along the full length of the attachment. The slot has flared edges that permit the attachment to be easily attached to the brim edge. As the edge attachment is mounted on the edge of a cap or visor the flared edges are deformed outward creating a spring force that firmly holds the edge attachment on the brim. The edge attachment may have an extension that extends over the top of a brim to provide additional space for the display of words, graphics, etc. that are larger than can be displayed on the much narrower front or top edge of the attachment. Barbs on the inside of the edging attachment near the slit bite into the top and bottom of the brim to further assist in holding the attachment on the brim.

2 Claims, 4 Drawing Sheets

EDGING FOR BRIM OF CAP OR VISOR

FIELD OF THE INVENTION

This invention relates to baseball-style caps and sun visors and, more particularly, to an edging that can be placed on the edge of the brim of the cap and visor to change their appearance and to repair the brim of the cap or visor.

BACKGROUND OF THE INVENTION

Baseball caps and visors are very popular. They are not only a functional item in many sports activities to protect a wearer's eyes from sunlight, and for team identification, and they are also regular wearing apparel for persons in all walks of life. Such caps and visors are functional in sports, may be purely ornamental, may have names, information of all types, and advertising thereon on either the top or front edge of the brim or on the main portion of the cap. Girls wear such caps and visors for ornamental and fashion purposes with desired colors and patterns thereon. Small items of jewelry, pins, badges and other paraphenalia are often mounted on either the brim or on the main portion of the cap. With such personal modifications such caps and visors have become personal fashion statements or personal identity items.

For some individuals changing the appearance of a baseball cap or visor for decorative, fashion changes or other reasons is very important. Fashionable and desirable baseball caps and visors have become moderately expensive so the need exists to be able to repair and/or to change their appearance in an inexpensive manner.

SUMMARY OF THE INVENTION

The present invention is a novel edging attachment that is added onto the brim of a baseball type cap or a brimmed visor. The edging attachment is available in many physical configurations, colors and patterns that permit a person to easily change the appearance of the cap or visor. Names, advertisement and other information of many kinds may be printed on or pressed into the top or front edge of the edging attachment. The dimensions and overall shape of the edging attachment may be varied to provide sufficient space for such names, advertisement and information of many kinds. The top portion of the edging attachment may have a portion that extends over the top of a cap or visor brim and provides additional space on which to display words, pictures and color patterns.

The novel edging attachment may be also used to repair the brim of a cap or visor. Over time, with much use, the peripheral edge of the brim of a cap or visor will become worn, dirty and ragged. A person may not want to give up a favorite cap or visor but, instead, want to repair the damages or worn peripheral edge. The novel edging attachment permits this to be done in an inexpensive manner.

The novel edging attachment is shaped so that it is easily mounted on the edge of the brim of a cap or visor and is reliably held thereon by friction fit. There is a slit along and through the side of the edging attachment that has a flared opening to enable the brim of a cap or visor to more easily enter through the slot into the interior of the attachment when mounting the attachment to a brim. The width of the spacing along the side of the attachment is less than the width of a brim so the flared opening is forcibly spread open when the edging attachment is mounted on the brim of a hat. This forcibly spreading creates a spring force that holds the edging attachment securely to the brim of the cap or visor.

In addition, the novel edging attachment is manufactured such that it can easily be cut to mount on different size cap or visor brims. The brim of some caps and visors extend further from a wearer's head than other caps and visors. Cutting guide marks are provided on the ends of the edging attachment to assist a person in cutting the attachment so that wording that is meant to be in the middle of the cap or visor will be so positioned after cutting and mounting.

BRIEF DESCRIPTION OF THE DRAWINGS

The invention will be better understood upon reading the following Detailed Description in conjunction with the drawing in which.

DETAILED DESCRIPTION

Figure 1:
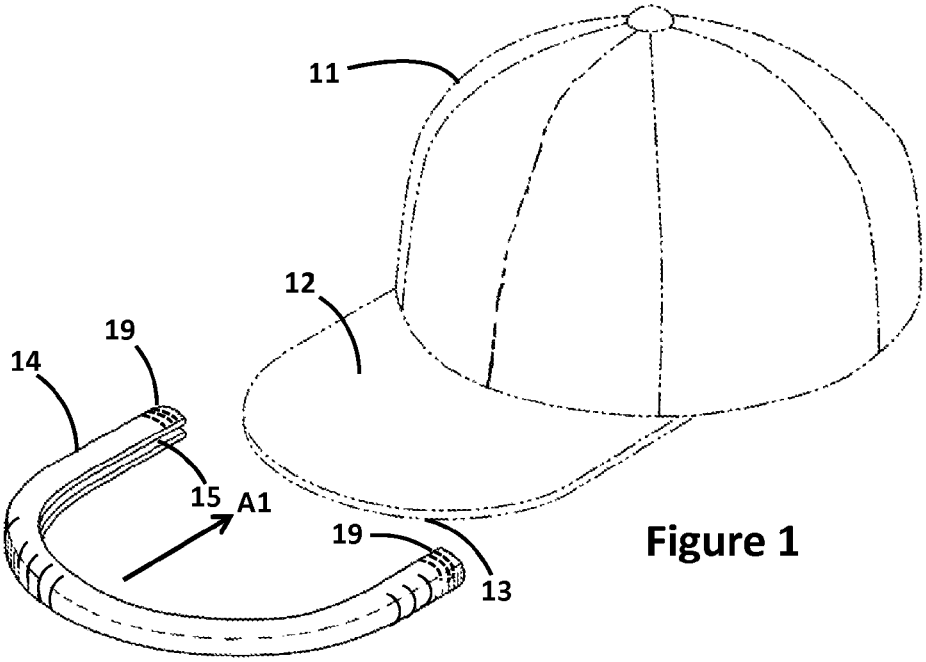
FIG. 1 is a three dimensional view showing a baseball type cap with a piece of novel attachment edging about to attached thereto.

In FIG. 1 is shown a three dimensional view of a baseball type cap 11 having an extending brim 12. An edging attachment 14 that utilizes the teaching of the invention, and having a slit 15 to its interior, is moved in the direction of arrow A1 until brim 12 is inserted into and is retained inside attachment 14 as is better shown in and described with reference to FIGS. 4, 5 and 6. The front edge of attachment 14 is rounded as shown. The dotted line is only an aid in understanding the shape of attachment 14.

Shown on the top of both ends of edging attachment 14 in FIG. 1 are a series of lines 19. These lines 19 are cutting guides that are used when edging attachment 14 is cut to fit the brim of a cap 11. Caps 11 and visors (not shown) have brims that extend different distances from the portion of the cap 11 that sits on a person's head. Edging attachment 14 comes long enough to fit any size brim 12. When fitting edging attachment 14 to a cap 11 a person places attachment 14 on top of brim 12 and determines how much to cut off either end of attachment 14. They then cut to a particular line 19 on either side and fit attachment 14 to brim 12 as described further in this Detailed Description with reference to FIGS. 4, 5 and 6. Only three dotted cutting guide lines 19 are shown in FIG. 1 but there may be more. Cutting guide lines 19 are not shown in FIG. 2 for the sake of simplicity. The main purpose for trimming the ends of edging attachment 14 equal amounts is that any words, numbers etc. (not shown) on the top or front edge of attachment 14 and exactly in the middle thereof will still be in the middle after attachment 14 is fitted to cap 11 as shown in FIG. 2.

Figure 2:
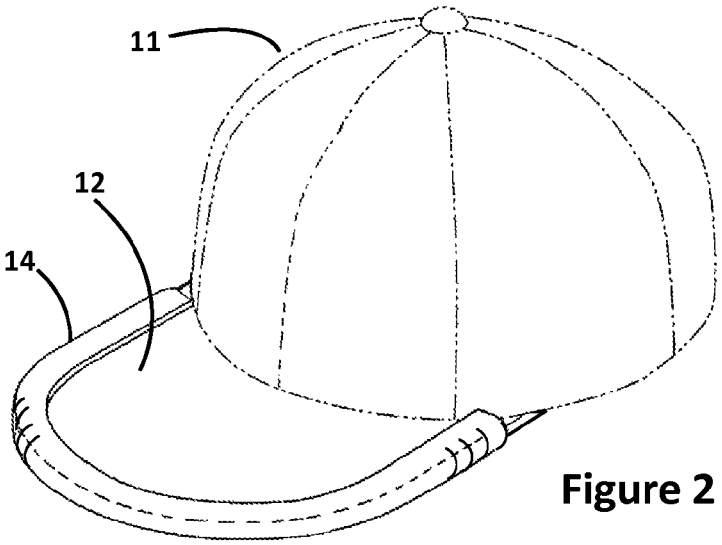
FIG. 2 is a three dimensional view showing a baseball type cap with a piece of novel attachment edging already attached thereto.

In FIG. 2 is shown a three dimensional view of a cap 11 having an edging attachment 14 mounted thereon after it has been cut to a desired length. The finer details of how attachment 14 is attached to and is held on brim 14 are shown in and described with reference to FIGS. 4, 5 and 6.

Figure 3:
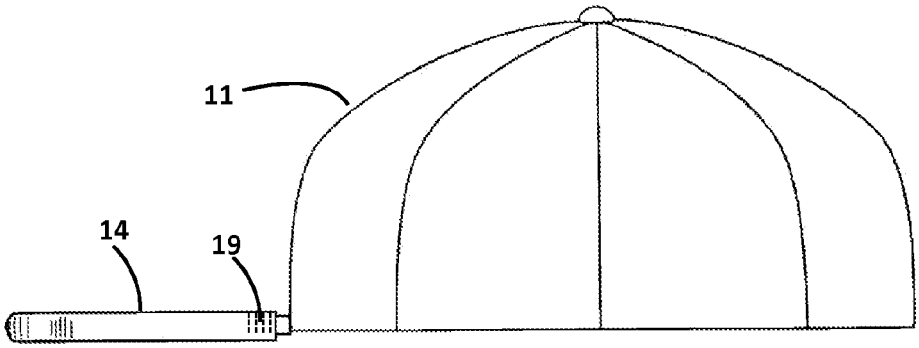
FIG. 3 is a side view of a baseball type cap with a piece of novel attachment edging already attached thereto.

In FIG. 3 is shown a side view of cap 11 with an edging attachment 14 attached to brim 12. The details of how it is attached and is held thereon are shown in and described with reference to FIGS. 4, 5 and 6.

Figure 4:
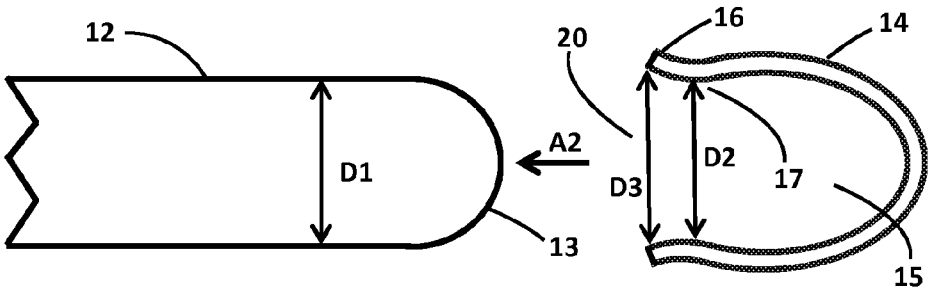
FIG. 4 is a side cross section view of the novel edging attachment about to be mounted on the tip of the brim of a cap or visor.
Figure 5:
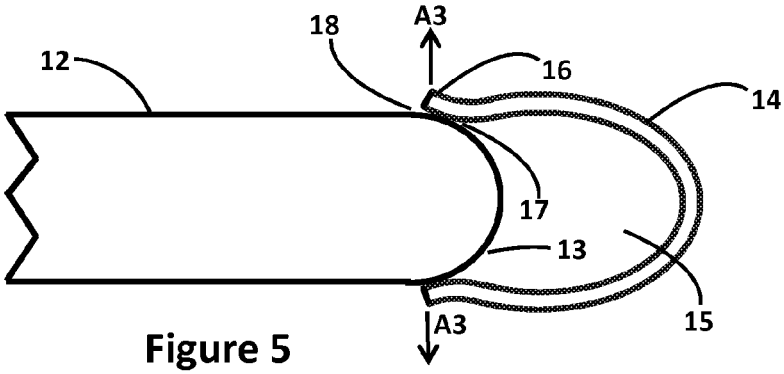
FIG. 5 is a side cross section view of the novel edging attachment touching the tip of a brim of a cap or visor so that the interference fit is seen.
Figure 6:
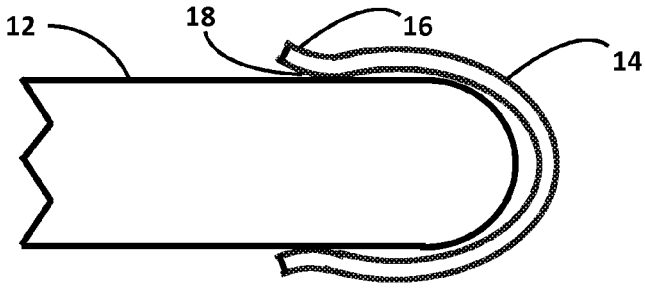
FIG. 6 is a side cross section view of the novel edging attachment mounted on the tip of a brim of a cap or visor with the interference fit causing a reliable mounting thereon.

In FIG. 4 is shown an enlarged cross sectional, cutaway view of edging attachment 14 and a cross sectional view of a portion of a cap brim 12 as attachment 14 is being moved in the direction of arrow A2 to be attached to the edge 13 brim 12. This cutaway view is used because it best shows how edging attachment 14 is attached to the edge of brim 12. FIG. 5 shows edging attachment 14 as it first comes into contact with the outer edge 13 of brim 12 as it is being mounted thereon. FIG. 6 shows edging attachment 14 as it is seated fully onto brim 12.

As seen in the enlarged cross sectional view of FIG. 4 edging attachment 14 has a slit 20 through its side and along its entire length. The edges 16 of attachment 14 along slit 20 are flared as shown in FIGS. 4, 5 and 6 so there is a distance D3 between the inner edge of the tips of the flared edges 16. Brim 12 of cap 11 has a thickness D1. The distance D3 is greater than the distance D1 so tip 13 of brim 12 can easily start to enter slit 20 as shown in FIG. 5 before encountering any resistance during mounting.

There is a distance D2 between the inner surface of flared edges 16 of attachment 14 as shown in FIG. 4. Distance D2 is less than distance D1 so that brim 12 of hat 11 cannot slide easily into space 15 inside edging attachment 14 as shown in FIG. 6.

In FIG. 5 edging attachment 14 has moved in the direct of arrow A2 (FIG. 4) far enough so that tip 13 of brim 12 comes into contact at point 18 with the inner surface 17 of flared edges 16 of attachment 14 as shown. This occurs because distance D1 is greater than distance D2 (FIG. 4). As edging attachment 14 is pushed further onto brim 12 tip 13 of brim 12 forces flared edges 16 outward as depicted by arrows A3. Edging attachment 14 is made of a stiff enough plastic or other material so that this can be done without undue force. When flared edges 16 are deformed outward in the direction of arrows A3 a spring force is created which pushes inward against the top and bottom of brim 12 as shown in FIG. 6.

FIG. 6 shows edging attachment 14 fully pushed onto brim 12. The spring force created by the outward deformation of flared edges 16 pushes against the top and bottom of brim 12 as shown. This occurs because with distance D1 being greater than distance D2 flared edges cannot return to their original, relaxed position. This force is sufficient to keep edging attachment 16 firmly attached onto the edge of brim 12 as shown in FIG. 2.

In FIGS. 4, 5 and 6 edging attachment 14 has a minimal depth on its inside 15. This is done for simplicity of presentation. This provides a minimal amount of space on the top and bottom of attachment 14 for any words, numbers, pictures, colors, and other decorations etc. However, this depth may be increased to provide more space on the top and bottom of attachment 14 for the words, numbers, pictures, colors, and other decorations etc. The minimal depth of space 15 is acceptable if edging attachment 14 is utilized only to protect or repair tip 13 of brim 12. The depth will typically be increased for all other purposes.

Figure 7:
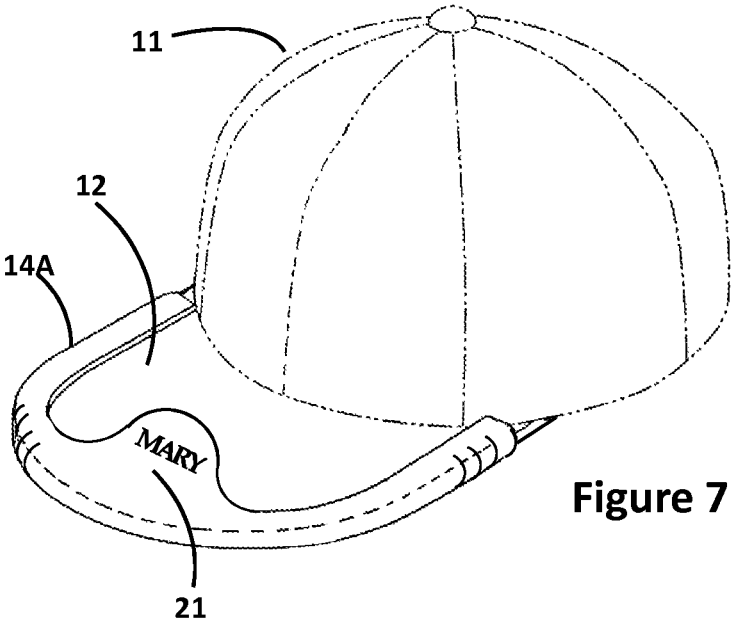
FIG. 7 is a three dimensional view showing a baseball type cap with a piece of novel attachment edging attached thereto where the edging has an extended area over the top of the brim of a cap for greater display purposes.

In FIG. 7 is shown a variant of the novel edging attachment 14A which has an extension 21 that extends a ways over the top of brim 12 as shown. The additional space on extension 21 permits more words and graphics, larger words and graphics, etc. to be displayed on top of brim 12. The shape of extension 21 may be changed from that shown in FIG. 7 and could cover most or all of the top of brim 12.

Figure 8:
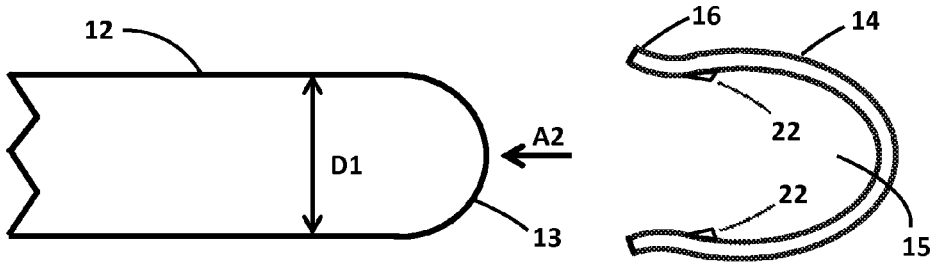
FIGS. 8 through 10 show an alternative embodiment of the invention where the attachment edging has a pointed barb on its inside lip that assists holding the edging on the brim of a cap.
Figure 9:
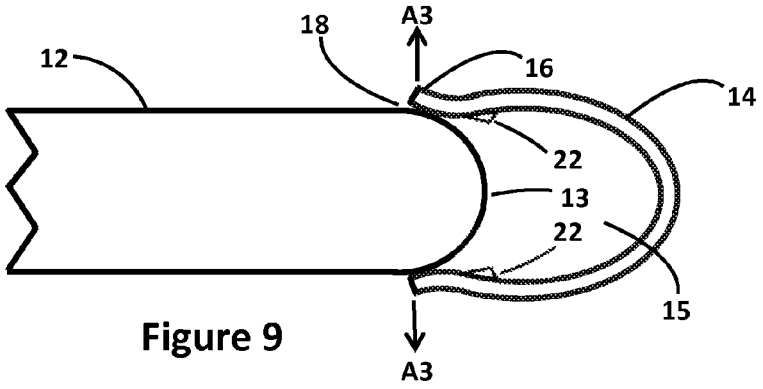
Figure 10:
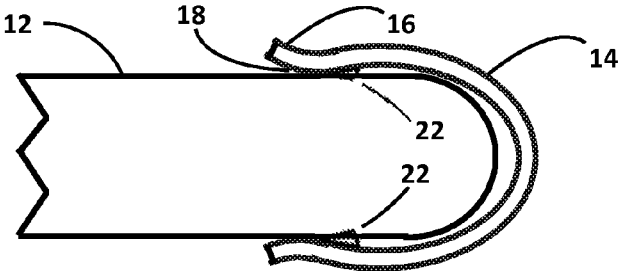

FIG. 8 through 10 show an alternative embodiment of the invention which is basically the same as the embodiment shown in FIGS. 4 through 6 except for the pointed protrusions or barbs 22 shown on the inside of edging attachment 14 near the flared ends 16. The position of the barbs 22 can be moved somewhat and still accomplish the same goal of using them to hold edging attachment 14 on the edge of brim 12 even better than just using the previously described spring force alone created by deforming the ends of attachment 14 outward as shown by arrows A3 in FIG. 9. Barbs 22 may be discreet individual protrusions or, when edging attachment 14 is manufactured by plastic extrusion techniques, may be continuous pointed protrusions parallel to the top and bottom of the slit through and along the length of brim 12.

Barbs 22 are not equilateral triangle shaped as may be seen in FIGS. 8 and 9. Rather, they have a flatter sloped front edge facing the open side slit of edging attachment 14. Thus, they can relatively easily ride up onto the front edge of brim 12 as edging attachment 14 is being mounted on the brim 12 as previously described. The sloped edge of barbs 22 furthest inside edging attachment 14, away from the opening, have a relatively steep slope as seen. The exact slopes are not critical. The slopes can be the same to facilitate easier removal of attachment 14 from brim 12. Once edging attachment 14 is fully mounted on the brim 12 of a hat or visor, such as shown in FIG. 10, the tip of barbs 22 bite into the top and bottom of brim 12 a little as shown in FIG. 10. This helps prevent inadvertent removal of attachment 14 from brim 12. While barbs 22 are described herein as being on the top and bottom of brim 12, this facet of the invention can work with barbs 22 on the top or the bottom of brim 12.

While what has been described herein is the preferred embodiment of the invention those skilled in the art will understand that numerous changes may be made without departing from the spirit and scope of the invention. For another example, an extension such as that shown (21) on top of brim 12 in FIG. 7 may be provided on the underside of brim 12.

The invention claimed is:

1. An attachment for an extending brim of a cap or visor, the brim having a peripheral edge along the sides of the cap or visor and the brim has a thickness, the attachment comprising:

an elongated piece of material having a length and a side and a general "U" shaped cross section created by a slit through the side and along the length of the elongated piece of material, the slit having two opposite edges, the two opposite edges of the slit and the portion of the elongated piece of material adjacent thereto each being flared outward and away from each other and the two opposite edges of the slit are spaced apart a first distance that is greater than the thickness of the brim of the cap or visor to permit the brim to easily enter into the slit, wherein the portion of the elongated piece of material nearest to each of the two opposite flared edges of the slit are spaced from each other a second distance that is narrower than the thickness of the brim of the cap or visor, and when the attachment is mounted on the peripheral edge of the extending brim of the cap or visor the brim causes the sides of the elongated piece of material adjacent to the flared edges of the slit move outward away from each other, the spreading creating a spring force that retains the attachment on the brim, wherein the attachment has two ends and has an extension extending over the top of the brim away from its peripheral edge that is equally spaced between the two ends and on which is imprinted words, numbers, or graphics, wherein the edge attachment has a second length such that the two ends are spaced a distance greater than the first length of the peripheral edge of the brim on the cap or visor, and the attachment further comprising:

a plurality of spaced marks on each of the two ends of the attachment, the spaced marks are necessary for the purpose of being an aid in trimming equal amounts from each of the two ends of the attachment when fitting the attachment to the brim of a cap or visor so that the extension is centered on the brim of the cap or visor, and the length of the attachment after trimming is the same as the first length of the cap or visor.

2. The attachment for the peripheral edge of an extending brim of a cap or visor of claim 1 further comprising a plurality of pointed protrusions on either side of the slit through the side of the attachment, the protrusions being located further inside the slit than a point where the second distance is located, the pointed protrusions on either side of the slit having a shape of a ramp with a pointed top and having a first surface and a second surface, the first surface having a first angle up which the brim of the hat or visor passes as the attachment is attached to the brim of the hat or visor, the second surface having a second angle steeper than the first angle, and when the attachment is fully mounted on the brim of a hat or visor having top and bottom surfaces and the pointed top of the protrusions dig into the top and bottom surfaces of the attachment and the second steeper angle makes it difficult to remove the attachment from the brim of the hat or visor.

* * * * *